US006474772B1

(12) United States Patent
Kawamura et al.

(10) Patent No.: US 6,474,772 B1
(45) Date of Patent: Nov. 5, 2002

(54) METHOD OF DETERMINING THERMAL TURN ON ENERGY

(75) Inventors: Naoto Kawamura, Corvallis, OR (US); Erik D Ness, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/908,311

(22) Filed: Jul. 17, 2001

(51) Int. Cl.[7] ..... B41J 2/01
(52) U.S. Cl. ..... 347/19
(58) Field of Search ..... 347/5, 9, 14, 19, 347/11, 60

(56) References Cited

U.S. PATENT DOCUMENTS 5,418,558 A 5/1995 Hock et al. ..... 347/14
5,428,376 A 6/1995 Wade et al. ..... 347/14
5,714,989 A * 2/1998 Wade ..... 347/14
5,726,690 A * 3/1998 Bohorquez et al. ..... 347/15
6,086,190 A 7/2000 Schantz et al. ..... 347/81
6,315,381 B1 * 11/2001 Wade et al. ..... 347/19

* cited by examiner

*Primary Examiner*—Craig Hallacher

(57) ABSTRACT

A method of determining thermal turn on energy is disclosed. The method comprises heating a fluid ejection device to a predetermined temperature that is below a fluid ejection temperature; applying firing pulse bursts to a resistor of said fluid ejection device, the pulses in each of said bursts having a predetermined reference pulse energy and a predetermined pulse frequency to eject a predetermined count of fluid droplets; and incrementally varying the drop count from said predetermined count while sampling the temperature of the fluid ejection device after said pulse bursts are applied.

39 Claims, 4 Drawing Sheets

METHOD OF DETERMINING THERMAL TURN ON ENERGY

FIELD OF THE INVENTION

The present invention relates generally to determining thermal turn on energy (TTOE), more particularly for fluid ejection devices.

BACKGROUND OF THE INVENTION

Inkjet printing is a non-impact printing process in which droplets of ink are deposited on print media, such as paper, transparency film, label stock, textile and other materials. Inkjet printing involves the ejection of fine droplets of ink onto the print media in response to electrical signals generated by a microprocessor.

There are two basic means currently available for achieving ink droplet ejection in inkjet printing: thermally and piezoelectrically. In thermal inkjet printing, electrical resistance heating is used to vaporize the ink, which produces a bubble which acts as a piston to expel ink through an orifice in the inkjet printhead toward the print medium. Printheads of this type are provided with a plurality of orifices, each orifice being associated with an electrical heating resistor which, when electrically energized, vaporizes and ejects ink droplets from an ink chamber associated with the orifice and resistor. A microprocessor selects the appropriate resistors to be fired and directs an electrical current thereto to achieve resistive heating and consequential ejection of ink vaporized by the heating through the orifice associated with the selected resistor.

A thermal inkjet printer requires a certain minimum energy to fire ink drops of the proper weight and volume, herein called TTOE. TTOE differs for different printhead designs and varies among different samples of a single printhead design as the result of manufacturing tolerances and among resistors within a printhead. As a result, thermal ink jet printers are operated at a fixed ink firing energy that is greater than the expected TTOE for the printhead cartridges it can accommodate. The TTOE test is a test run in the printer to determine the average operating energy for a given printhead so that manufacturing variations can be dealt with on a printhead by printhead and printer by printer basis.

It is accordingly desired to provide a TTOE test in which the number of ink droplets required for the test is reduced with resultant reduction in the generation of objectionable aerosol and wasted ink.

SUMMARY

In one embodiment of the present invention, a method of determining thermal turn on energy comprises heating a fluid ejection device to a predetermined temperature that is below a fluid ejection temperature; applying firing pulse bursts to a resistor of said fluid ejection device, the pulses in each of said bursts having a predetermined reference pulse energy and a predetermined pulse frequency to eject a predetermined count of fluid droplets; and incrementally varying the drop count from said predetermined count while sampling the temperature of the fluid ejection device after said pulse bursts are applied.

Many of the attendant features of this invention will be more readily appreciated as the same becomes better understood by reference to the following detailed description and considered in connection with the accompanying drawings in which like reference symbols designate like parts throughout.

DETAILED DESCRIPTION

Figure 1:
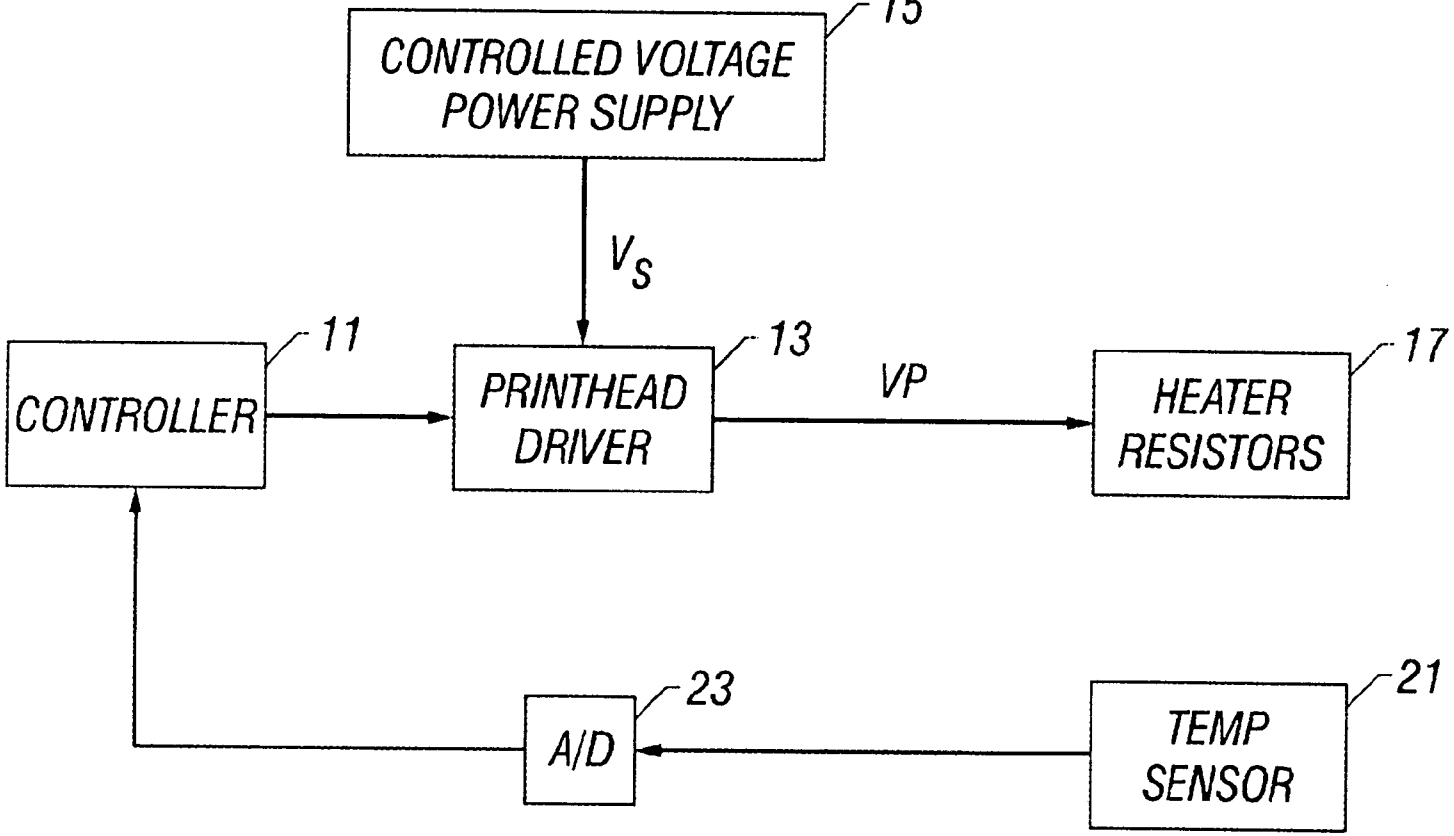
FIG. 1 is a schematic block diagram of the thermal ink jet components for implementing one embodiment of the invention.

In the following detailed description and in the several figures of the drawing, like elements are identified with like reference numerals.

Referring now to FIG. 1, shown therein is a simplified block diagram that employs the techniques of one embodiment of the invention. A controller 11 receives print data input and processes the print data to provide print control information to a printhead driver circuit 13. A controlled voltage power supply 15 provides to the printhead driver circuit 13 a controlled supply voltage $V_s$ whose magnitude is controlled by the controller 11. The printhead driver circuit 13, as controlled by the controller 11, applies driving or energizing voltage pulses of voltage VP to a fluid ejection device (or, in one embodiment, a thin film integrated circuit thermal ink jet printhead) that includes a drop ejector (or heating element, or, in one embodiment, a thin film ink drop firing heater resistor) 17. The voltage pulses VP are typically applied to contact pads that are connected by conductive traces to the heater resistors, and therefore the pulse voltage received by an ink firing resistor is typically less than the pulse voltage VP at the printhead contact pads. Since the actual voltage across a heater resistor cannot be readily measured, turn on energy for a heater resistor as described herein will be with reference to the voltage applied to the contact pads of the printhead cartridge associated with the heater resistor. The resistance associated with a heater resistor will be expressed in terms of pad to pad resistance of a heater resistor and its interconnect circuitry (i.e., the resistance between the printhead contact pads associated with a heater resistor).

The controller 11, which can comprise a microprocessor architecture in accordance with known controller structures, more particularly provides pulse width and pulse frequency parameters to the printhead driver circuitry 13 which produces drive voltage pulses of width and frequency as selected by the controller, and with a voltage VP that depends on the supply voltage $V_s$ provided by the voltage controlled power supply 15 as controlled by the controller 11. The controller 11 controls the pulse width, frequency, and voltage of the voltage pulses applied by the driver circuit to the heater resistors.

The integrated circuit printhead of the thermal ink jet printer of FIG. 1 also includes a temperature sensor 21, comprising a thermal sensing resistor for example, located in proximity to the heater resistors, and provides an analog electrical signal representative of the temperature of the integrated circuit printhead. The analog output of the temperature sensor 21 is provided to an analog-to-digital (A/D)

converter 23 which provides a digital output to the controller 11. The output of the A/D converter is thus directly indicative of the temperature detected by the temperature sensor 21.

Figure 2:
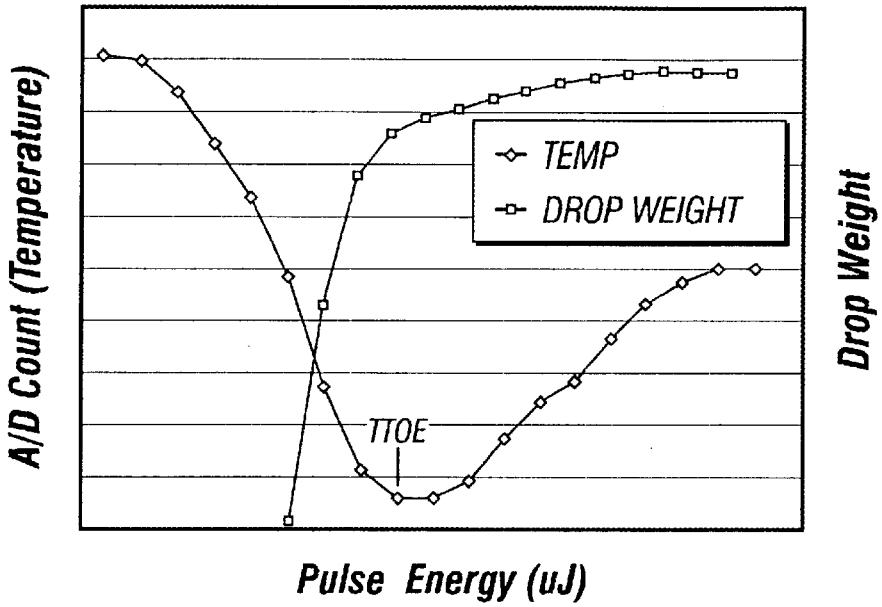
FIG. 2 is a representative graph showing printhead temperature and ink drop weight plotted against pulse energy applied to the heater resistors of an inkjet printhead in an embodiment of the present invention.
Figure 3:
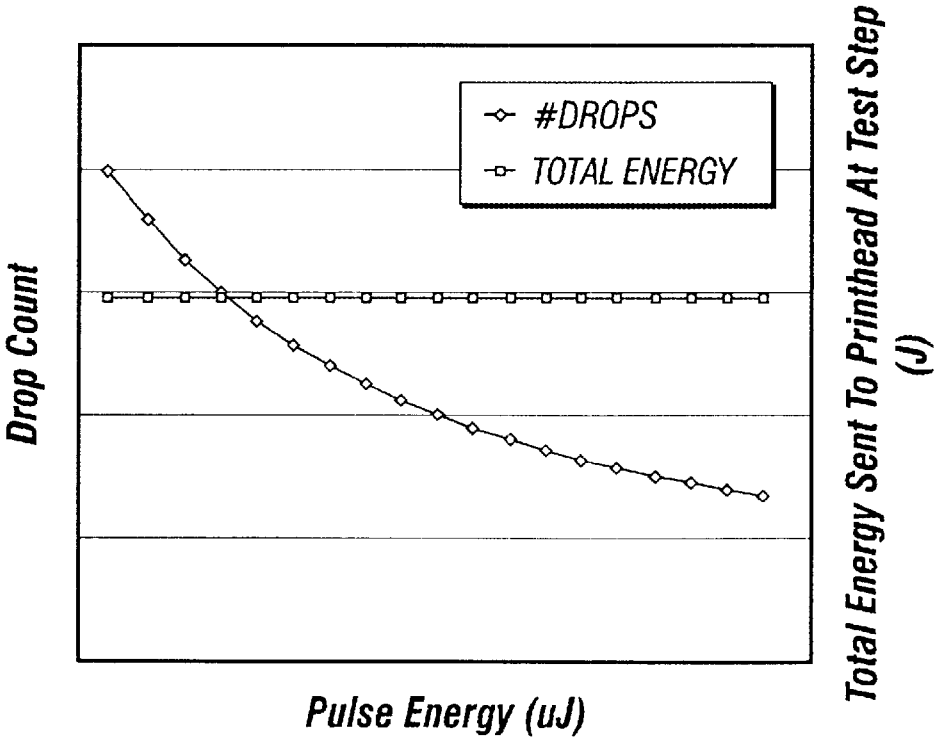
FIG. 3 is a graph showing drop count and total energy sent to the printhead during the test plotted against pulse energy applied to the heater resistors of the printhead in an embodiment of the present invention.

In accordance with the invention, the controller 11 determines a TTOE for the printhead 19 that is the minimum pulse energy at which a heater resistor produces an ink drop of the proper weight or volume, wherein pulse energy refers to the amount of energy provided by a voltage pulse, i.e., power multiplied by pulse width. FIG. 2 shows representative temperature and ink drop weight curves prepared from discrete normalized printhead temperature sampling and normalized ink drop weight data plotted against pulse energy applied to each of the heater resistors of a thermal ink jet printhead. The discrete printhead temperatures for the temperature curve are depicted by diamonds ( ) while discrete drop weights utilized for the ink drop weight curve are depicted by solid squares ( ).

The characteristic temperature, Tchar, of a printhead is the maximum temperature to which a printhead can rise with a given drop weight and energy per drop. No matter how many drops are fired, the printhead temperature cannot rise higher than Tchar because it is the temperature of a drop of ink assuming that all of the energy used to fire it actually went into the drop.

In accordance with the invention, the printhead is tested for its minimum T TOE generally as follows with reference to FIGS. 4A and 4B. After presetting the drop count C to a minimum level Cmin and presetting the pulse width W to a maximum Wmax, the printhead is first warmed to a predetermined temperature, which will be above the TTOE temperature, by applying energy to the inkjet resistors 17, preferably by using a pulse width much shorter than is required to eject ink droplets from the printhead. The printhead alternatively may be warmed by application of voltage to the firing resistors lower than the voltage required to eject ink or by using a separate printhead heating resistor, not shown. This is done to raise the printhead temperature to near the characteristic temperature of the first energy step.

Following pre-heating of the printhead, firing energy higher than the TTOE energy is applied to the printhead in progressively decreasing or increasing energy bursts of pulse width W, frequency F and voltage V and sample temperatures as digitized by the A/D converter 23 are collected and stored after each pulse burst. In the first part of a test using incrementally decreasing energy settings higher than the TTOE, the temperature of the printhead drops as the energy per drop is decreased due to convective cooling and removal of heat by the ink droplets. As the energy drops below the TTOE, the drop weight decreases and the amount of heat that the fired ink droplets can remove decreases more quickly than the amount of heat added and the printhead temperature therefore rises. After the printhead stops firing ink altogether, the printhead achieves a new steady state temperature given the rate of inputted energy and the rate of thermal losses.

In a first embodiment of the invention, the process uses predetermined incremental, preferably progressive, decreases in the pulse width with simultaneous increase of the counted number C of ink drops fired by the printhead so that the total energy provided to the printhead by the controller during the pulse burst remains substantially constant. The process is repeated with progressively decreasing pulse widths and increasing drop counts until such time as the pulse width W has been reduced to a predetermined minimum pulse width $W_{min}$ at which time a smoothing algorithm is applied to the temperature samples prior to making a final determination of the minimum temperature on the temperature curve of FIG. 2 which represents the TTOE. The TTOE, as seen in FIG. 2, comprises the point at which both minimum temperature and minimum energy are located on the temperature curve. In one embodiment, the smoothing algorithm defines the value at that point to be:

$$0.5[\text{sample}(i)]+0.25[\text{sample}(i-1)]+0.25[\text{sample}(i+1)].$$

Preferably, the points of steepest positive and negative slopes of the temperature curve are determined following which a determination of whether the curve is concave between the points of steepest positive and negative slopes is made. If the curve is concave, the point of both minimum temperature and minimum energy defines the printhead TTOE and the corresponding pulse width which has been applied to the printhead resistors. If the test for concavity of the temperature curve reveals that the curve is not concave between the points of steepest positive and negative slopes of the curve, this is indicative of a printhead which should either be replaced or be operated at a nominal firing energy rather than at a calculated firing energy which exceeds the determined TTOE by a selected amount.

Those skilled in the art will appreciate that application of varying amounts of pulsed energy to the printhead may alternatively be accomplished by incrementally, preferably progressively, reducing the applied voltage rather than by incremental reduction in pulse width. If voltage is incrementally reduced, here again the drop count C is incrementally increased to insure that the total energy sent to the printhead by the controller during the pulse burst remains substantially constant. The set of temperature samples used to establish the temperature curve of FIG. 2 and the TTOE can also be collected by commencement of the test using a minimum pulse width or minimum voltage with incremental increases in the pulse energy or voltage as the drop count is incrementally decreased to insure that the total energy sent to the printhead during each burst remains constant. In this embodiment, where the drop count begins at a high number and is decreased accordingly, the high drop count may create build up of fluid in the ejection device, and may utilize a larger amount of fluid in the testing process than the embodiment where the drop count is increased. In another embodiment, whether the drop count begins high or low, the amount of fluid utilized is the same in both tests.

In summary, if the printhead is determined to be operating properly as exhibited by a concave temperature curve, the printhead will be operated at an energy that is greater than the determined TTOE and within a range that insures proper print quality while avoiding premature failure of the heater resistors. Various methods of accurately determining TTOE from the temperature samples will be apparent to those skilled in the art.

Figure 4A:
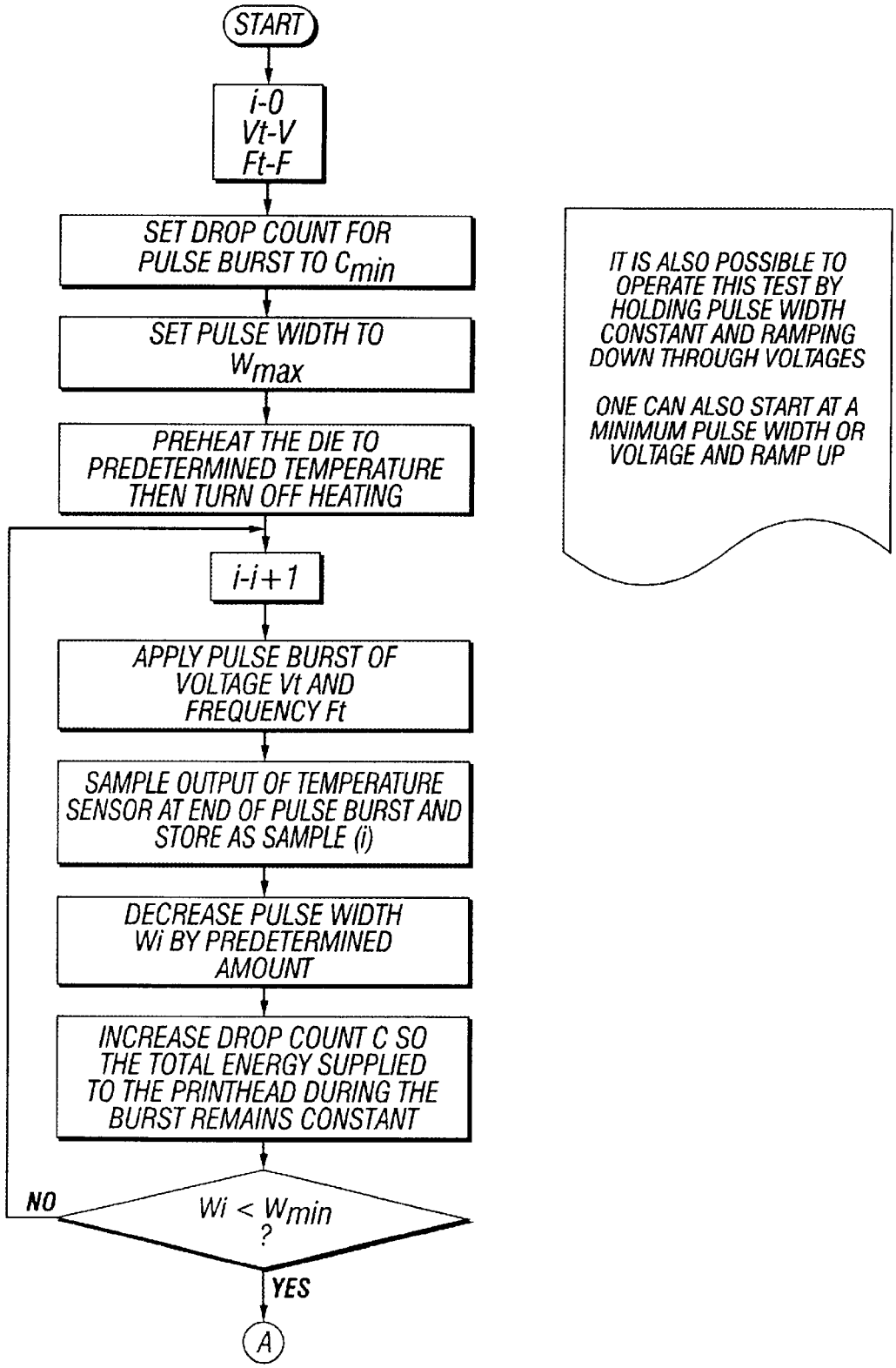
FIGS. 4A and 4B illustrate a block flow diagram of a procedure for determining printhead thermal turn on energy in an embodiment of the present invention.
Figure 4B:
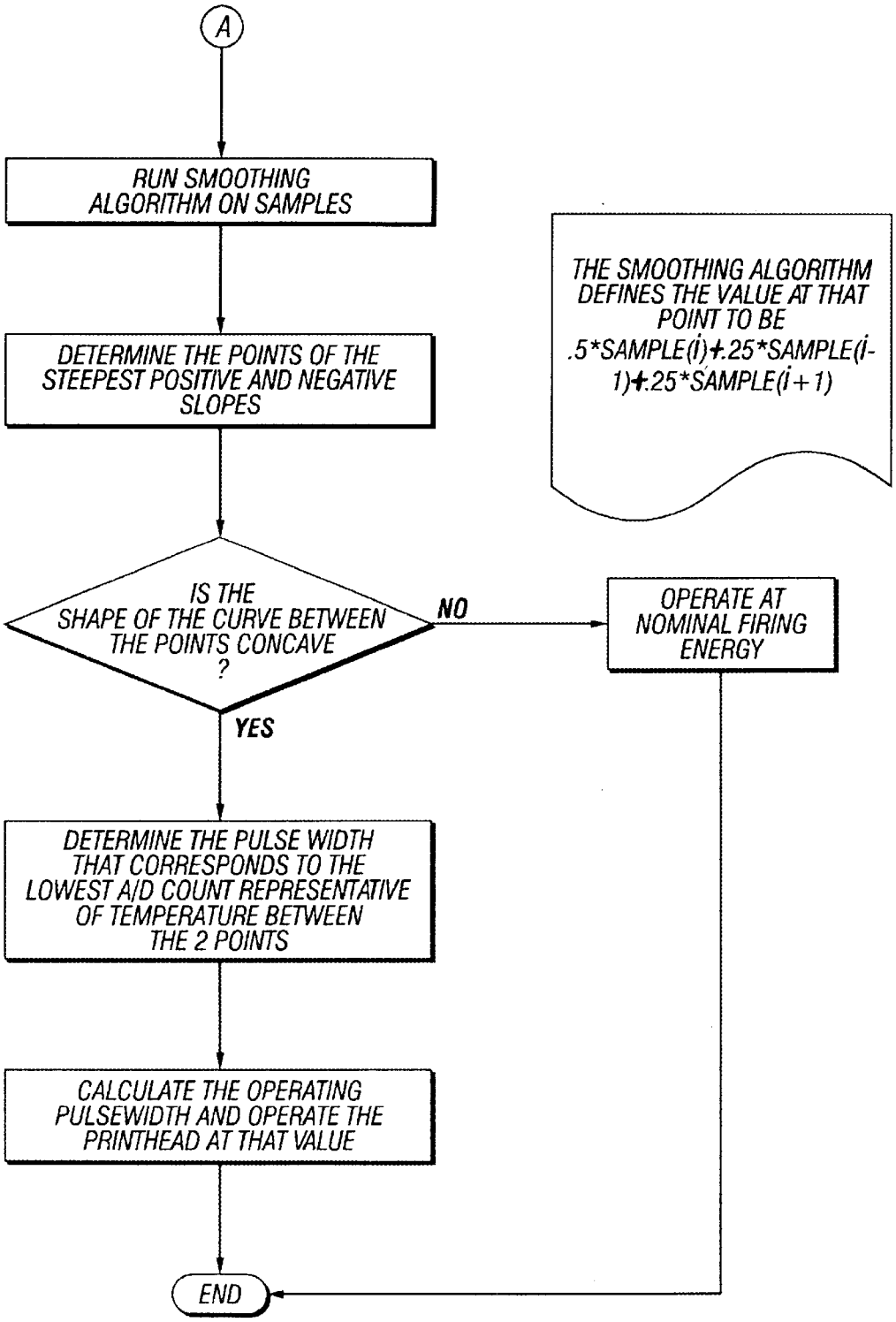

Commencing with a sample count i which is initialized to 0 in FIG. 4A, the applied voltage V and frequency F are set to provide a pulse energy that is sufficiently low that the printhead would be operating in the non-nucleating phase. As used herein, pulse energy is power applied to an ink firing resistor multiplied by pulse width.

With incremental increases in the sample count i, pulse bursts of incrementally decreasing (or increasing) pulse width W or voltage V are used with increasing (or decreasing) drop counts C as described above until the pulse width has dropped below (or above) the pre-established minimum (or maximum) pulse width Wmin or a pre-established minimum (or maximum) voltage following which the collected temperature samples are smoothed and the TTOE is determined and operation of the printhead at a temperature high enough above the TTOE to ensure proper printing takes place at the pulse width or voltage corresponding to the determined TTOE.

In one embodiment of the present invention, a constant number of ink drops is not fired through all of the energy settings used to establish the temperature curve. Instead, the algorithm of the present invention fires an increasing number of drops as the energy setting is decreased or vice versa so that the total energy input to the printhead during each pulse burst remains constant. As a result, in one embodiment, TTOE for the printhead is determined while saving time in the test, saving ink in the printhead and reducing the amount of ink aerosol that is produced. One may think that the same result of decreasing the number of drops fired may be achieved by simply reducing the number of drops in a constant drop count algorithm but the amount of energy inputted to the printhead becomes so small that the printhead does not approach its Tchar and thus, the indication of the lowest temperature point is not very obvious.

Those skilled in the art will appreciate that the present invention can be extended to fluid ejection devices other than thermal inkjet printheads, including for example thermal fluid ejection devices such as used in medical applications.

It is therefore to be understood that this invention may be practiced otherwise than as specifically described. Thus, the present embodiments of the invention should be considered in all respects as illustrative and not restrictive, the scope of the invention to be indicated by the appended claims rather than the foregoing description.

What is claimed is:

1. A method of determining thermal turn on energy comprising:

heating a fluid ejection device to a predetermined temperature that is below a fluid ejection temperature;

applying firing pulse bursts to a resistor of said fluid ejection device, the pulses in each of said bursts having a predetermined reference pulse energy and a predetermined pulse frequency to eject a predetermined count of fluid droplets; and incrementally varying the drop count from said predetermined count while sampling the temperature of the fluid ejection device after said pulse bursts are applied.

2. The method of claim 1 further comprising:

incrementally varying the pulse energies while incrementally varying the drop count;

producing a set of temperature samples of the fluid ejection device respectively associated with the varying pulse energies;

determining a minimum value of the temperature samples; and determining the lowest turn on energy which occurs at the minimum value of temperature samples to define said thermal turn on energy.

3. The method of claim 1 further comprising:

producing a set of temperature samples of the fluid ejection device respectively associated with the varying drop count;

determining a minimum value of the temperature samples; and determining the lowest turn on energy which occurs at the minimum value of temperature samples to define said thermal turn on energy.

4. The method of claim 1 further comprising starting with a pulse energy substantially equal to said predetermined reference energy.

5. The method of claim 1 wherein a net energy input to said fluid ejection device remains substantially constant from burst to burst.

6. The method of claim 1 wherein energy input to said fluid ejection device from the pulse burst remains substantially equal to energy output due to the drop count and associated thermal losses.

7. A method of determining thermal turn on energy comprising:

heating a fluid ejection device to a predetermined temperature;

applying firing pulse bursts to a resistor of said fluid ejection device, the pulses in each of said bursts having a predetermined reference pulse energy and a predetermined pulse frequency to eject a predetermined count of fluid droplets; and incrementally varying the drop count from said predetermined count while incrementally varying the pulse energies.

8. The method of claim 7, wherein said fluid ejection device is heated to said predetermined temperature by applying a series of electrical pulses of preselected maximum width to resistors of said fluid ejection device.

9. The method of claim 8, wherein said predetermined temperature is higher than a temperature that would be produced pursuant to firing pulses of said predetermined reference pulse energy and said predetermined pulse frequency.

10. The method of claim 7, wherein said incrementally varying pulse energies are progressively varied by varying a width of said pulses.

11. The method of claim 7, wherein said incrementally varying pulse energies are progressively varied by varying voltage applied to said resistors.

12. The method of claim 10, wherein said varying pulse energies are varied by progressively decreasing pulse width.

13. The method of claim 10, wherein said varying pulse energies are varied by progressively increasing pulse width.

14. The method of claim 11, wherein said varying pulse energies are varied by progressively decreasing said applied voltage.

15. The method of claim 11, wherein said varying pulse energies are varied by progressively increasing said applied voltage.

16. The method of claim 7 further comprising:

producing a set of temperature samples of the fluid ejection device respectively associated with the varying pulse energies;

determining a minimum value of the temperature samples; and determining the lowest turn on energy which occurs at the minimum value of temperature samples to define said thermal turn on energy.

17. The method of claim 16, wherein said thermal turn on energy is determined by locating a point of minimum temperature and lowest energy on a temperature curve fitted to said set of temperature samples in a region of said set of temperature samples that changes from decreasing to increasing pursuant to incrementally increasing pulse width.

18. The method of claim 17, wherein said thermal turn on energy is located by:

determining points of maximum positive and negative slopes of said curve;

determining whether the shape of said curve between said two points is upwardly concave; and determining a lowest pulse width that corresponds to a lowest temperature between the points of maximum positive and negative slopes.

19. The method of claim 18, wherein the fluid ejection device is operated at a constant pulse width that is above the pulse width at said thermal turn on energy if said shape of said curve is upwardly concave, and operated at a nominal pulse width if said shape is other than upwardly concave.

20. The method of claim 16, wherein said thermal turn on energy is determined by locating a point of minimum temperature and lowest energy on a temperature curve fitted to said set of temperature samples in a region of said set of temperature samples that changes from decreasing to increasing pursuant to incrementally increasing pulse voltage.

21. The method of claim 20, wherein said thermal turn on energy is located by:

determining points of maximum positive and negative slopes of said curve;

determining whether the shape of said curve between said two points is upwardly concave; and determining an applied voltage that corresponds to a lowest temperature and a lowest pulse energy between the points of maximum positive and negative slopes.

22. The method of claim 21, wherein the fluid ejection device is operated at an applied voltage that is above voltage applied at said thermal turn on energy.

23. A method of determining thermal turn on energy comprising:

heating a fluid ejection device to a predetermined temperature before ejecting fluid therefrom;

applying firing pulse bursts to a resistor of said fluid ejection device, the pulses in each of said bursts having a predetermined reference pulse energy and a predetermined pulse frequency to eject a predetermined count of fluid droplets; and sampling the temperature of the fluid ejection device after said pulse bursts are applied, wherein a net energy input to said fluid ejection device remains substantially constant during each burst.

24. The method of claim 23 wherein the net energy input remains substantially constant by keeping the energy input to said fluid ejection device from the pulse burst substantially equal to energy output due to the drop count and associated thermal losses.

25. The method of claim 23 further comprising incrementally varying the drop count from said predetermined count while incrementally varying the pulse energies.

26. The method of claim 25 further comprising starting with a pulse energy substantially equal to said predetermined reference energy.

27. A method of determining thermal turn on energy comprising:

heating a fluid ejection device to a predetermined temperature before ejecting fluid therefrom;

applying firing pulse bursts to a resistor of said fluid ejection device, the pulses in each of said bursts having a predetermined reference pulse energy and a predetermined pulse frequency to eject a predetermined count of fluid droplets; incrementally varying the pulse energies;

producing a set of temperature samples of the fluid ejection device respectively associated with the varying pulse energies;

locating a point of minimum temperature and lowest energy on a temperature curve fitted to said set of temperature samples in a region of said set of temperature samples that changes from decreasing to increasing pursuant to incrementally increasing pulse energy; and determining the lowest turn on energy which occurs at the minimum value of temperature samples to define said thermal turn on energy.

28. The method of claim 27, wherein said thermal turn on energy is located by:

determining points of maximum positive and negative slopes of said curve;

determining whether the shape of said curve between said two points is upwardly concave; and determining a lowest pulse energy that corresponds to a lowest temperature between the points of maximum positive and negative slopes.

29. The method of claim 28, wherein the lowest pulse energy is a lowest pulse width, and wherein the fluid ejection device is operated at a constant pulse width that is above the pulse width at said thermal turn on energy if said shape of said curve is upwardly concave, and operated at a nominal pulse width if said shape is other than upwardly concave.

30. The method of claim 28 wherein the lowest pulse energy is an applied voltage that corresponds to the lowest temperature and a lowest pulse energy between the points of maximum positive and negative slopes, wherein the fluid ejection device is operated at an applied voltage that is above voltage applied at said thermal turn on energy.

31. The method of claim 27 further comprising starting with a pulse energy substantially equal to said predetermined reference energy.

32. The method of claim 27 further comprising incrementally varying the drop count from said predetermined count while varying the pulse energies.

33. The method of claim 27 wherein a net energy input to said fluid ejection device remains substantially constant from burst to burst.

34. A method of operating a fluid ejection device comprising:

heating a resistor of a fluid ejection device to a predetermined temperature before ejecting fluid;

applying firing pulse bursts to said resistor, the pulses in each of said bursts having a predetermined reference pulse energy and a predetermined pulse frequency to fire a predetermined count of fluid droplets;

incrementally varying the drop count from said predetermined count;

sampling the temperature of the resistor after said pulse bursts are applied to said resistor to produce a set of temperature samples respectively associated with the varying drop count;

determining a minimum value of the temperature samples;

determining the lowest turn on energy which occurs at the minimum value of temperature samples to define said thermal turn on energy; and operating the printhead at a pulse energy above said thermal turn on energy.

35. A system to determine thermal turn on energy of a fluid ejection device comprising:

a means for applying pulse bursts to a resistor of said fluid ejection device, the pulses in each of said bursts having a predetermined reference pulse energy and a predetermined pulse frequency to eject a predetermined count of fluid droplets;

a means for incrementally varying the drop count from said predetermined count; and a means for sampling a temperature of the fluid ejection device after said pulse bursts are applied.

36. The system of claim 35 further comprising a means for keeping a net energy input to said fluid ejection device substantially constant from burst to burst.

37. The system of claim 35 further comprising a means for incrementally varying the drop count while varying the pulse energies.

38. An apparatus used to determine thermal turn on energy of a fluid ejection device comprises:

a driver that applies pulse bursts to a resistor of said fluid ejection device, the pulses in each of said bursts having a predetermined reference pulse energy and a predetermined pulse frequency to eject a predetermined count of fluid droplets;

a controller that incrementally varies the drop count from said predetermined count and gathers temperature samples after said pulse energies are applied for each drop count amount;

a software application that applies a smoothing algorithm to the temperature samples to determine a minimum temperature on a temperature curve, wherein the minimum temperature is at a point at which both minimum temperature and minimum energy are located on the temperature curve.

39. The apparatus of claim 38 wherein the controller incrementally varies the drop count while incrementally varying the pulse energy.

* * * * *